US005130914A

United States Patent [19]

Bengochea

[11] Patent Number: 5,130,914

[45] Date of Patent: Jul. 14, 1992

[54] LIGHT FIXTURE ASSEMBLY

[75] Inventor: Fulgencio Bengochea, East Meadow, N.Y.

[73] Assignee: Edison Price Lighting, New York, N.Y.

[21] Appl. No.: 636,069

[22] Filed: Dec. 28, 1990

[51] Int. Cl.[5] ..... F21S 1/00

[52] U.S. Cl. ..... 362/364; 362/365; 362/147; /

[58] Field of Search ..... 362/147, 148, 364, 365, 362/372, 404, 406, 368, 370, 427

[56] References Cited

U.S. PATENT DOCUMENTS

| | | | |
|---|---|---|---|
| 3,097,800 | 7/1963 | Schwartz | 362/226 |
| 3,609,346 | 9/1971 | Lund | 362/364 |
| 3,778,609 | 12/1973 | Liberman | 362/364 |
| 3,974,371 | 8/1976 | Miles, Jr. | 362/372 |
| 4,232,361 | 11/1980 | Kelsall | 362/364 |
| 4,510,559 | 4/1985 | Kristofek | 362/148 |
| 4,623,956 | 11/1986 | Conti | 362/148 |
| 4,745,533 | 5/1988 | Smerz | 362/364 |

*Primary Examiner*—Ira S. Lazarus
*Assistant Examiner*—Y. Quach
*Attorney, Agent, or Firm*—Darby & Darby

[57] ABSTRACT

A lighting fixture to be mounted within a ceiling comprising a housing, a rotatable collar and a lamp mount assembly, for holding a lamp in place. The lamp mount assembly is connected to a portion of the collar with a pivot arm. The pivot arm pivots between a zero degree tilt and a maximum degree tilt. The lamp mount assembly is connected to the pivot arm with a hinge so that the lamp mount assembly may be tilted with respect to the pivot arm between an operational position and an inoperational position to provide access to a normally inaccessible portion of the lamp. The lamp mount assembly returns to its original position after relamping without disturbing the previous lamp beam settings or adjustments.

10 Claims, 8 Drawing Sheets

LIGHT FIXTURE ASSEMBLY

FIELD OF THE INVENTION

The present invention relates to improvements in lighting fixtures generally of the type which are recessed within a ceiling and, in particular, to an improved lamp mount assembly which provides greater adjustment and accessibility to the lamp and lens.

BACKGROUND OF THE INVENTION

Recessed ceiling fixtures are commonly used as an effective light source. When coupled with a spotlamp bulb such as a halogen spotlamp, which produces a relatively narrow beam of intense light, the ceiling lamp becomes a recessed directional spotlamp and is useful for highlighting a subject or an otherwise unlit area. The recessed spotlamp is especially useful in stores having displays, such as clothed manikins, because the lamps themselves are hidden within a wall, floor or ceiling and therefore do not distract the viewer from the subject of interest.

These recessed spotlamps are not without problems, however. One problem stems from the fact that, since the lamp is recessed in a ceiling (or wall), it is difficult to access the lamp mount assembly to change a bulb (or a lens filter) or readjust the direction of the beam. In a conventional fixture, the lamp mount must first be removed from the ceiling. This usually entails the removal of a cover plate, and then the removal of the lamp mount assembly. In consequence, it is likely that lamp replacement will disturb the previous beam alignment, and the beam from the new bulb will have to be realigned.

A related problem of removing the entire lamp mount assembly during routine maintenance (lamp and lens replacement, etc.) is that store personal are exposed to the electrical wiring of the lamp. Although most lamps used in such applications are only 12 volts DC, which pose no danger, the more dangerous 120 volts is usually supplied to a nearby transformer within the lamp housing. Thus, repeated lamp replacement over time may increase the risk of electrical injury.

SUMMARY OF THE INVENTION

An object of the invention is to provide improvements in recessed lighting fixtures which result in fixtures that are safer, more versatile and easier to maintain and adjust.

Another object of the invention is to provide means for easily adjusting and aligning a lamp of a recessed lighting fixture.

Another object of the invention is to provide means for easily removing a spotlamp of a recessed lighting fixture without removing the entire lighting fixture assembly from the ceiling and without disturbing the alignment of the spotlamp.

These objects are achieved in accordance with the present invention by providing a light fixture mounted within a ceiling having a lamp for producing a beam of light through an opening in the ceiling. The lamp has a front portion from which light is emitted and a rear portion at which electrical connections are made. The fixture has a collar positioned around the ceiling opening and is rotatable within a first plane. The fixture also has a lamp mount assembly for holding the lamp, and a pivot arm connected to the lamp mount assembly and pivotally connected to a point along the collar. The pivot arm is movable between a zero degree position, wherein the beam emitted from the front portion of the lamp is directed through the opening substantially perpendicular to the first plane, and a maximum degree position wherein the beam is directed through the opening at a maximum degree with respect to the first plane. The fixture also has means for tilting the lamp mount with respect to the pivot arm so that the rear portion of the lamp becomes accessible through the opening.

In operation, the beam of light from the lamp may be directed to one of many positions within an imaginary cone through two movements. One movement involves rotating the collar with respect to the ceiling. The other movement involves adjusting the lamp assembly (and the pivot arm) to an angular position between the zero degree position and the maximum degree position. The collar and the pivot arm may be selectively secured to maintain the desired beam direction.

In accordance with the invention, although the pivot arm may be secured at a desired angular position, the lamp assembly may further be selectively and independently pivoted about the end of the pivot arm in a third movement, so that the rear portion of the lamp assembly becomes accessible through the opening of the ceiling. This accessibility proves useful when the lamp bulb or lens must be replaced or cleaned.

According to the invention, these three movements (rotation, beam angle, and lamp replacement) may be advantageously achieved by means of an efficient, economical, and ergonomically satisfying combination of element. The final construction is relatively simple, and represents a marked improvement over prior devices.

These and other objects and advantages of the present invention will be described in more detail in the following description, and in conjunction with the accompanying drawings.

DETAILED DESCRIPTION OF THE INVENTION

The present invention may be used in a variety of lighting applications including internally mounted (recessed) lamps within walls, ceilings and even floor boards, and externally mounted track lighting. The preferred embodiment is a recessed ceiling lighting fixture.

The following terms are defined to help describe the invention:

The terms "upper" and "lower" are taken with respect to the mounted position of the lighting fixture, the ceiling is up, the floor is down.

"Inwardly" refers to a direction towards the center of an opening 24 of a ceiling fitting, as shown for example in FIG. 4 (described below);

"Outwardly" refers to a direction away from the center of the opening 24.

Figure 1:
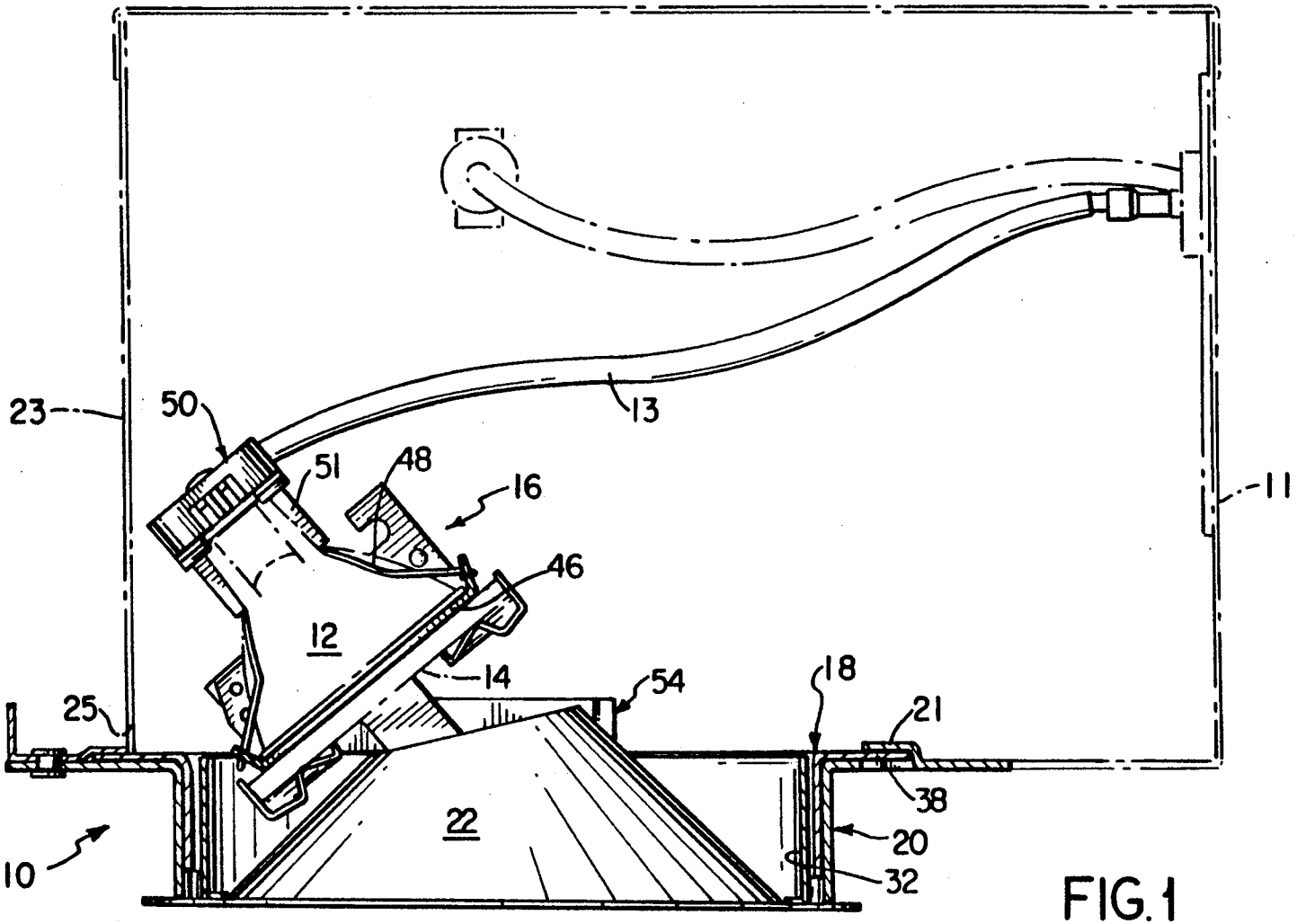
FIG. 1 is a partially sectional side view of a lighting fixture, in accordance with the invention, positioned within a housing.

In accordance with the present invention, a recessed lighting fixture 10 is shown in FIG. 1 installed in a housing 11 mounted within a ceiling and connected to electrical input wires 13. The lighting fixture 10 comprises a lamp 12, a lens 14, a lamp mount assembly 16, a lamp rotation collar 18, a ceiling fitting 20, and a reflector assembly 22.

The ceiling fitting 20 is attached to the housing 11 and supports the lamp mount assembly 16, the lamp 12, the diffusion lens 14, the lamp rotation collar 18 and the reflector assembly 22. The ceiling fitting 20 in the mounted position lies either coplanar with or adjacent to the ceiling. The ceiling fitting 20 is preferably made from sheet metal such as steel and is cut to shape depending on the size and shape of the opening formed in the ceiling to receive it.

Figure 2:
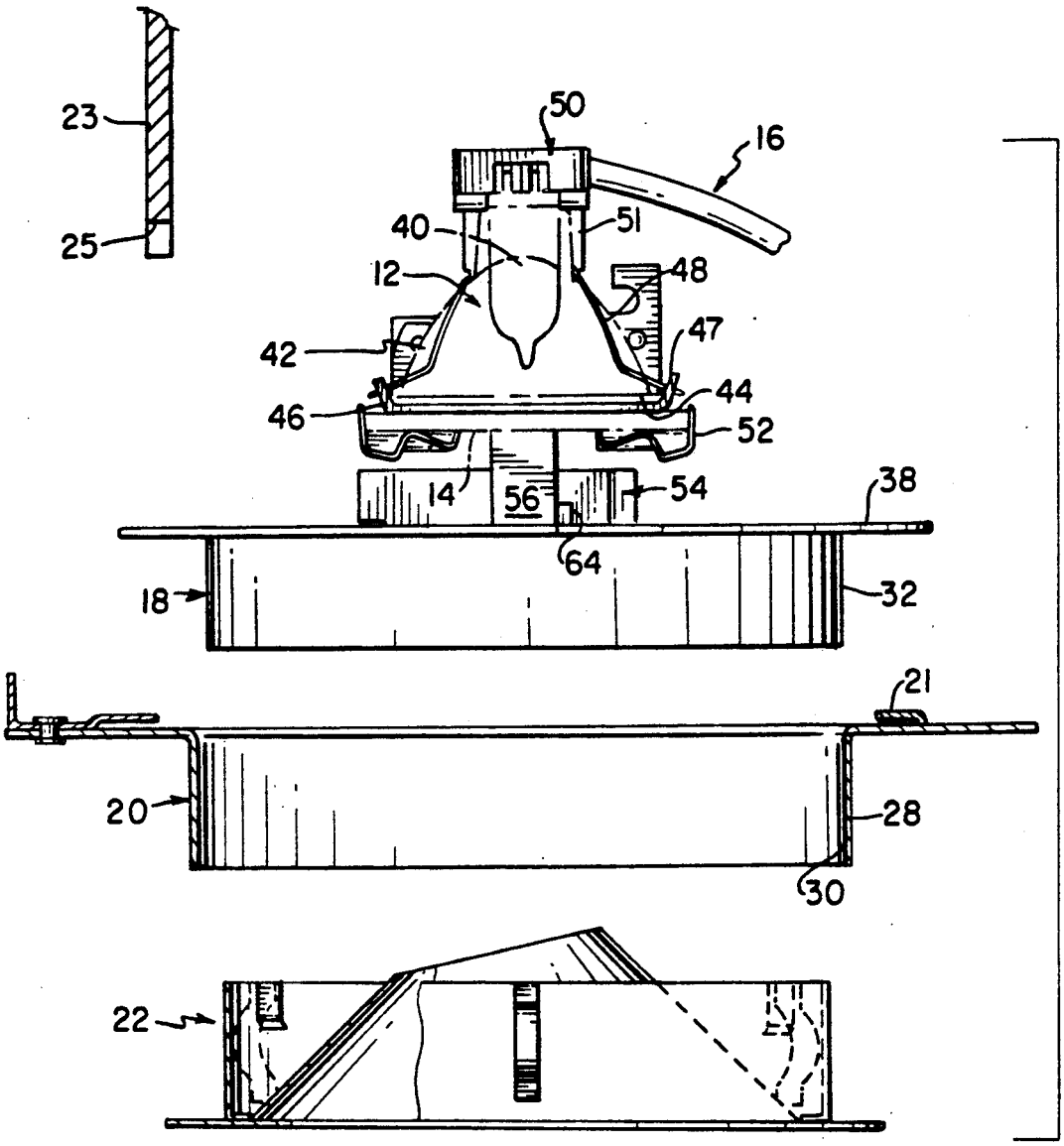
FIG. 2 is a partially exploded rear view of the lighting fixture, including a lamp mount assembly, a ceiling fitting, and a reflector.
Figure 3:
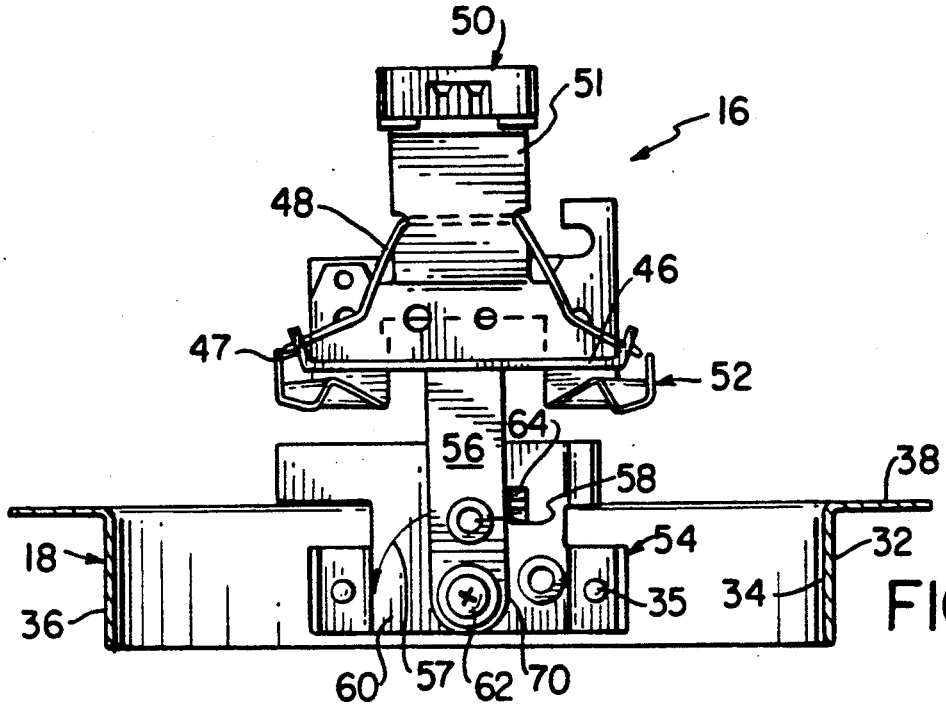
FIG. 3 is a front partial sectional view of the lighting fixture showing the lamp mount assembly and a ceiling fitting.
Figure 4:
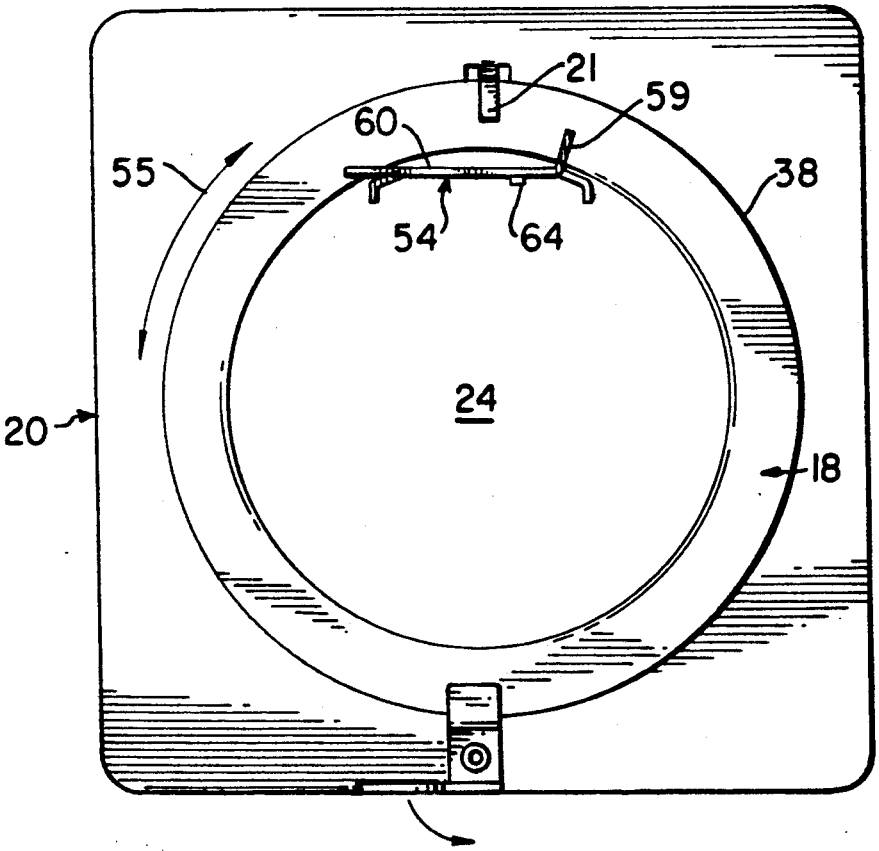
FIG. 4 is a top plan view of the ceiling fitting with a lamp rotation collar shown in a mounted position.

Referring to FIGS. 2, 3, and 4, the ceiling fitting 20 includes a depending circular flange 28 (FIG. 2) defining a central opening 24 (FIG. 4). The flange 28 functions as a rotation collar support wall having an inner surface 30. The opening 24 receives the rotation collar 18. The flange 28 is preferably formed integrally with the ceiling fitting 20.

The rotation collar 18 is also preferably made from sheet metal and includes a depending cylindrical wall 32, having an outside diameter slightly less than the inside diameter of the flange 28. The cylindrical wall 32 includes an inside surface 34, an outside surface 36 and an outwardly directed flange 38 which is perpendicular to the cylindrical wall 32. The wall 32 of rotation collar 18 is rotatably received in opening 24 of the ceiling fitting 20 from the top down. The flange 38 rests on top of fitting 20 and prevents the rotation collar 18 from falling through the opening 24 while permitting rotation of the collar 18 within the opening 24 with respect to the ceiling fitting 20.

The lamp 12 (FIG. 2) may vary, but is generally a sealed halogen twelve volt bulb 40, similar to automotive headlamp halogen bulbs, mounted within a bulb reflector 42. As shown in FIG. 2, the bulb 40 including the bulb reflector 42 are unitary and are collectively referred to as the lamp 12. The bulb reflector 42 includes a rim 44 which may be one of a variety of shapes, for example, circular or rectangular, again depending on the type of lamp and the intended application. In the embodiment shown, the bulb reflector 42 has a circular rim 44.

Figure 11:
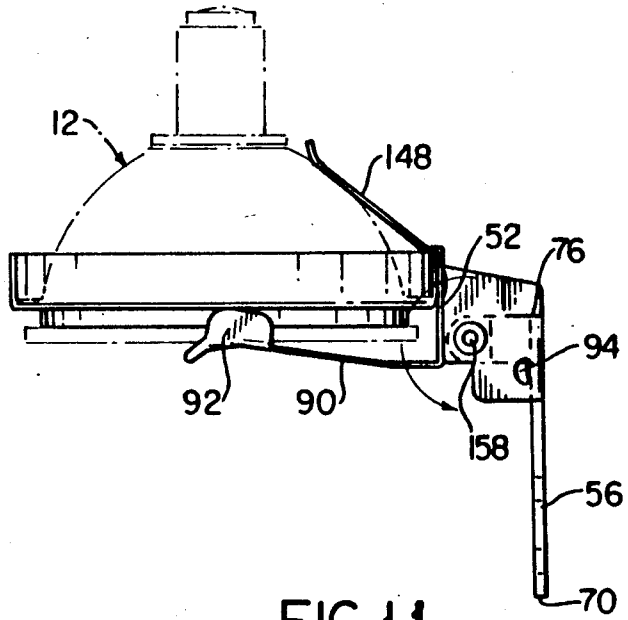
FIG. 11 is a side view of the lamp mount assembly of FIG. 9, showing a mounted lamp (in phantom)
Figure 12:
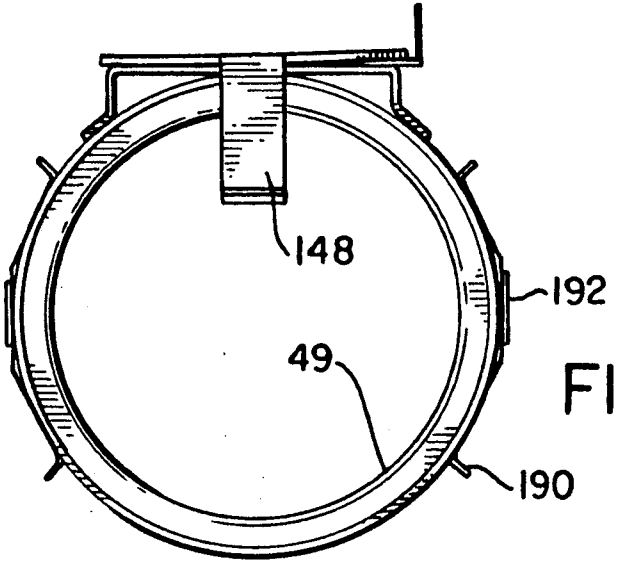
FIG. 12 is a top view of another embodiment of the lamp assembly having a modified lens support arrangement.

The lamp mount assembly 16 can easily be modified to receive any shape bulb or type of bulb, and such modifications would be within the scope of the invention. Also, the type of lamp terminals and mechanical socket connectors will vary from bulb to bulb, depending on the particular design. For example, terminal designs which may be used are either two isolated flush terminals with two prong bayonet mechanical connectors, as shown in FIGS. 11 and 12, or two isolated post terminals which are also used as mechanical connectors, as shown in FIGS. 1, 2, 3 and 5. The two post terminals of this second type are parallel to each other and project directly away from the bulb (from the rear of the bulb reflector 42) and are designed to be received by a two isolated-channel socket 50 which is similar to the bulb and socket configuration of one end of a fluorescent bulb tube.

Figure 5:
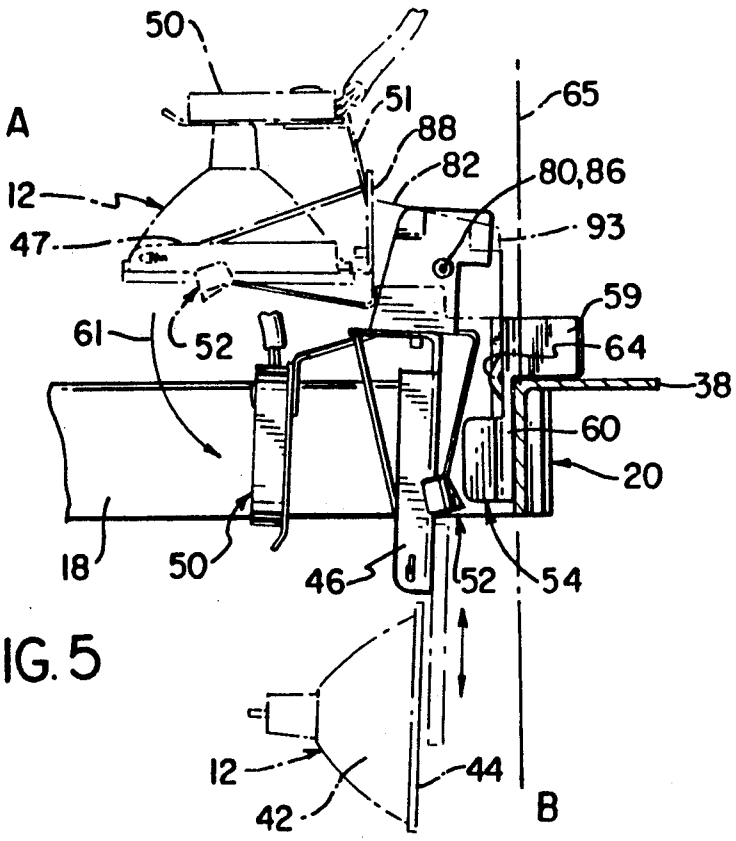
FIG. 5 is a partial sectional side view of the lighting fixture showing the lamp mount assembly in both operational and non-operational positions.

As shown for example in FIG. 5, the lamp 12 is connected to the socket through transverse movement with respect to the beam of light emitted from the bulb. The bulb is supported and held within the lamp mount assembly by a lamp support plate 46 which is described in greater detail below.

In a preferred embodiment of the invention, the lamp mount assembly 16, shown in FIG. 3, includes a lamp support plate 46, lamp retaining arms 48, a lamp socket 50, a lens mount 52, a tilt bracket 54 attached to the rotation collar 18, a pivot arm 56 whose lower end, a pivot end 70 is pivotally attached to the tilt bracket 54, and a pivot point (opening 58-FIG. 4) for attaching the lamp support plate 46 (and the lens mount 52) to the top of the pivot arm 56. The lamp socket 50 is preferably attached to an extension arm 51 of the lamp support plate 46, thereby simplifying manufacture.

Figure 17:
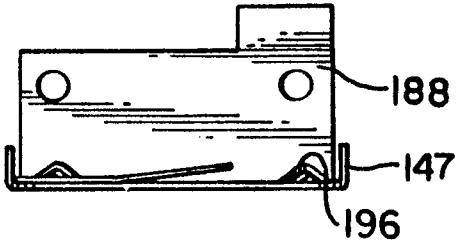
FIG. 17 is a front view of the lamp support plate of FIG. 15 showing details of lens mount.
Figure 16:
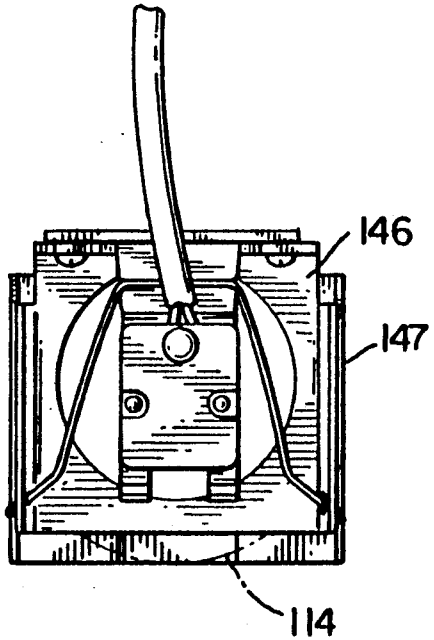
FIG. 16 is a top view of the lamp support plate of FIG. 15.

The shape of the lamp support plate 46 depends on the type and shape of lamp used. For standard rectangular or round rimmed reflector domes, the support plate 46 shown in FIGS. 15 through 17 is preferred. The support plate shown in FIGS. 9 through 14 is intended to support only round rimmed reflector domes.

In either case, the support plate 46 includes a central opening 49 (FIGS. 9, 12 and 15) through which light from the lamp 12 may pass to form the output beam. As discussed above, the support plate, regardless of the shape, also functions to support the rim portion 44 of the lamp and retain the terminals of the bulb in the socket connector.

As shown in FIGS. 1 and 4, the ceiling fitting 20 includes an inwardly directed upstruck tab 21. The tab 21 is preferably formed integrally with ceiling fitting 20 and is positioned so that when the rotation collar 18 is mounted in the opening of the ceiling fitting 20, as shown in FIG. 4, the tab 21 lies above the flange 38. The clearance between the flange 38 and the tab 21 is such that the rotation collar 18 may be easily removed from the tab 21. A housing side 23 is provided with a notch 25, when housing 11 of FIG. 1 is mounted to ceiling fitting 20. This secures the rotation collar 18 to the ceiling fitting 20, while allowing free rotation of collar 18. The tab 21 extends far enough inwardly so that it engages an outwardly bent portion 59 of the tilt bracket 54 at a certain point during rotation of the rotation collar 18 within the ceiling fitting 20, thereby preventing more than a single rotation of the collar 18. Limiting the collar 18 to only one rotation eliminates any problems associated with a twisted power supply lead.

Referring to FIG. 5, the lamp may be easily inserted and removed into and from the lamp mount assembly. The lamp 12 is electrically and mechanically connected to the lamp mount assembly 16 by positioning the lamp rim 44 along the surface of the lamp support plate 46 and sliding the lamp 12 towards the lamp socket 50. The lamp terminals are aligned so that they will be properly received by the terminal channels of the lamp socket 50. When the lighting fixture is installed into the recess of a wall or a ceiling, the lamp mount assembly will normally be positioned in an operative position which is represented by position A, shown in FIG. 5. Therefore, in order to allow a user to easily slide the rim portion of a lamp along the lamp support plate, the invention provides that the lamp support plate be pivotal about an axis 80 (shown in FIG. 6), between the operative position A and an inoperative position represented by position B in FIG. 5. The lamp may easily be slid along the lamp support plate when the support plate is in the inoperative position B. Once the lamp is installed onto the lamp support plate, the lamp support plate may be re-pivoted back to the operative position A.

The lamp support plate 46 is preferably shaped to guide the lamp 12 to its mounted position. This may include side walls 47, as shown in FIGS. 3, 19 and 21. Once the lamp 12 reaches its mounted position in the lamp mount assembly 16, the lamp retaining arms 48 will envelop a portion of the reflector 42 and, due to the resilient nature of the arms 48, will retain the lamp 12 in the mounted position, until physically pulled therefrom during removal (as shown in FIG. 3).

Figure 6:
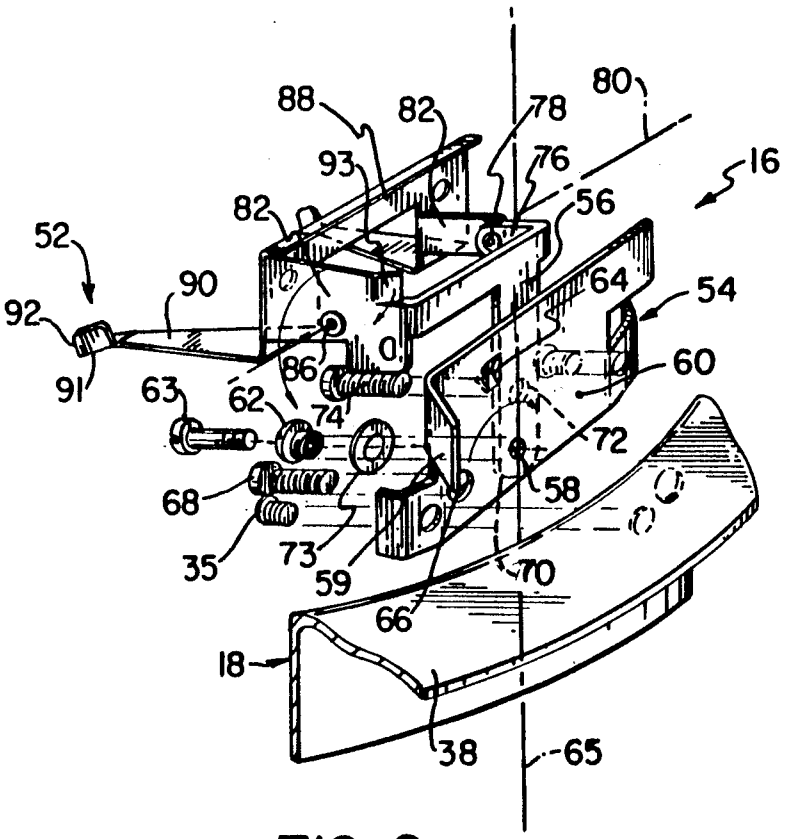
FIG. 6 is an isometric exploded view of the lamp mount assembly of the invention.

Referring to FIG. 6, the tilt bracket 54 of the lamp mount assembly 16 is preferably made from sheet metal such as steel. The bracket 54 may be attached to the inside surface 34 of the collar 18 (FIGS. 3, 5 and 6) by rivets 35 or by spot welding. The tilt bracket 54 has a flat inner surface 60, and includes a threaded pivot opening 58 which is sized to receive a fastener 63. The tilt bracket 54 also includes a stop detent 64 and a lock opening 66 for receiving a bolt or screw 68 for locking the rotation collar 18 with respect to the ceiling fitting 20, as later described. The flat inner surface 60 of the tilt bracket 54 lies in a plane which is perpendicular to the ceiling fitting 20.

The pivot arm 56 shown in FIG. 6 is preferably made from sheet metal, such as steel. The pivot arm 56 is generally "T" shaped and includes a pivot end 70, a tilt-lock opening 72 for receiving a tilt-lock bolt 74 and a pair of inwardly directed opposed hinge arms 76. Both hinge arms 76 have an opening 78 which is centered on, and defines a hinge axis 80. An opening is provided at the pivoting end 70 of the pivot arm 56 which is aligned with the pivot opening 58 and is sized to receive a bushing 62 and a spring washer 73 (FIG. 6). The pivot end 70 of the pivot arm 56 is attached to the tilt bracket 54 by the fastener 63 secured to the threaded pivot opening 58. The pivot arm 56 is provided limited pivotal displacement about fastner 63, from zero degrees tilt wherein a portion of the pivot arm 56 engages the stop detent 64 of the tilt bracket 54 to a maximum tilt of approximately 90 arc degrees in the preferred embodiment. The pivot arm 56 defines a longitudinal axis 65 which is parallel to the flat inner surface 60 of the tilt bracket 54.

As shown in FIGS. 3 and 6, the lens mount 52 includes a wall 88 having inwardly extending arms 82. The arms 82 are hingably connected to the respective hinge arms 76 with rivets 86 along the hinge axis 80. The lamp mount assembly 16 can be rotated about the hinge axis 80 between the operational position and the inoperational position, as shown in FIG. 5.

At the operational position shown in FIG. 6 and at position A in FIG. 5, the combined lengths of the hinge arms 76 and the connection arms 82 center the lamp 12 with respect to the opening 24 of the ceiling fitting 20 so that the output beam of light from the lamp 12 may be directed perpendicular from the ceiling to the floor through the center of the opening of the ceiling fitting 20. When pivoted to the inoperational position, as shown at position B of FIG. 5, the lamp support plate lies adjacent and substantially parallel to the longitudinal axis 65 and the tilt bracket 54.

Figure 8:
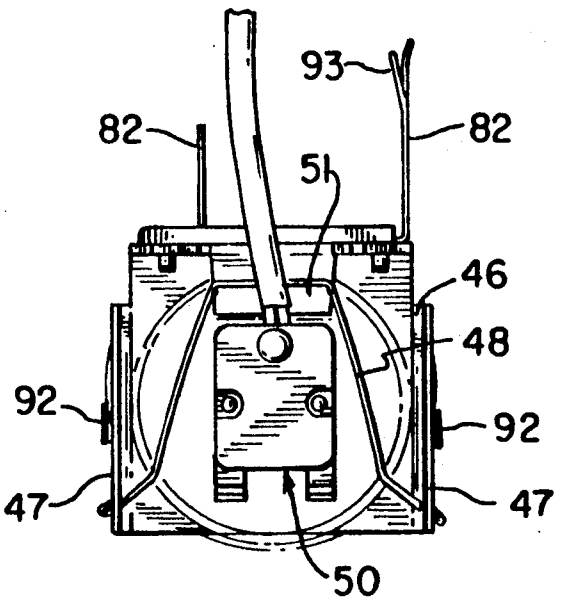
FIG. 8 is an upper plan view of the lamp mount assembly showing details of an electrical connector, lamp retaining arms and a lamp support plate.
Figure 7:
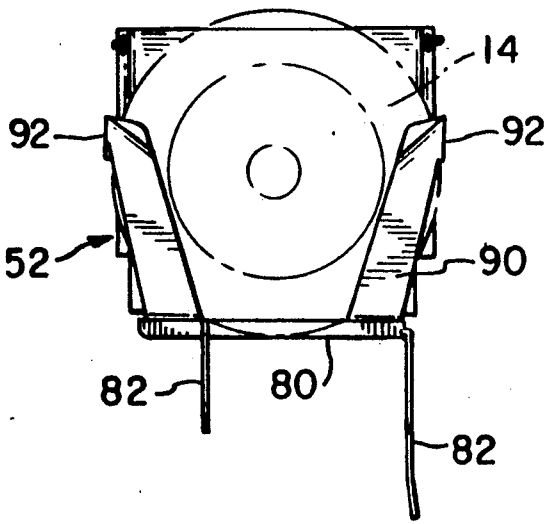
FIG. 7 is a bottom plan view of the lamp mount assembly showing details of lens supporting arms, a lens and the lamp in accordance with the invention.

The lens mount 52 is preferably made from sheet spring steel and is bent to the shape described above and generally shown in FIGS. 6 and 7. As shown in FIG. 6, formed integrally with the wall 88 are forwardly directed lens support arms 90 that terminate in downwardly tapering end portions 91. The lens support arms 90 are formed so that they lie below the lamp support plate 46 and taper outwardly so they do not obstruct any outgoing light from the illuminated lamp 12. The lens support arms 90 are also shaped so that a lens 14 (FIG. 7), precut to a shape similar to the shape of the lamp support plate 46 (FIG. 8), can be slid between the lower surface of the lamp support plate 46 and the upper surface of the lens support arms 90 and held in position by the resilient nature of the lens support arms 90. Upright wall portions 92 help guide the lens 14 to its proper mounted position.

Figure 9:
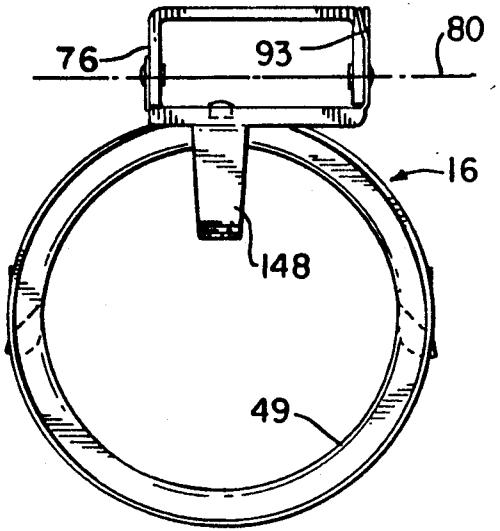
FIG. 9 is a top view of a second lamp mount assembly in accordance with a second embodiment of the invention.
Figure 10:
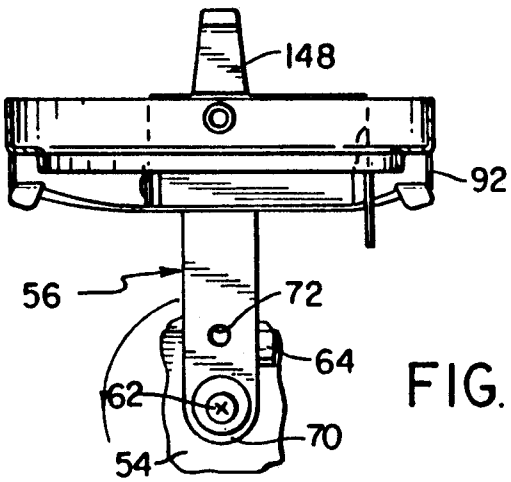
FIG. 10 is a front view of the lamp mount assembly of FIG. 9.

Referring to FIGS. 9 through 11, a preferred lens mount of the invention is shown. One connection arm 82 of the lens mount includes an in-turned stop tab 93 (FIG. 9) and a resistance detent 94 (FIG. 11). The stop tab 93 abuts an upper surface of one hinge arm 76 when the lamp mount 16 is at its ninety degree position. The resistance detent is formed so that it contacts one side surface of the same hinge arm 76 and creates resistance to the displacement of the lamp mount assembly 16 about the hinge axis 80 from the dotted line position to the solid line positions shown in FIG. 5.

In operation, three basic movements of lamp 12 are provided, each of which may effect the direction of the illuminated beam. One movement is lamp rotation which may be effected by rotating the rotation collar 18 with respect to the ceiling fitting 20. This action causes no apparent beam change if the lamp is not tilted, and is mounted and positioned in the center (the beam is directed perpendicular to the ceiling). The rotation movement is shown for example in FIG. 4 by arrow 55. Another movement is that the pivot arm 56 may be pivoted about the pivot point (opening 58) of the tilt bracket 54. This pivoting action will relocate the output beam between center or zero degree tilt wherein the beam is directed straight at the floor, for example (perpendicular to the floor) to the degree of maximum tilt which varies from design, but is about 50 arc degrees from the perpendicular, for example. This movement, when combined with the rotation of the collar 18, provides positioning control covering an imaginary cone shaped volume extending from the lamp to the floor at twice the maximum tilt angle. The tilt movement is shown for example in FIG. 3 by arrow 57.

A third movement will effect the beam output, but is only intended to provide access to the lamp 12 and the lens 14 and it is expected that the lamp will be turned off before initiating the third movement. The third movement is a swing movement of the lamp mount assembly 16 from a ninety degree position with respect to the pivot arm 56 to a zero degree position, moving within the imaginary plane, as discussed above. As shown in FIG. 5 and discussed above, the lamp 12 is operational when the lamp mount assembly 16 is substantially in the ninety degree position and is accessible (e.g. for replacement) when it is substantially in the zero degree position. This movement is shown in FIG. 5 by arrow 61.

Figure 14:
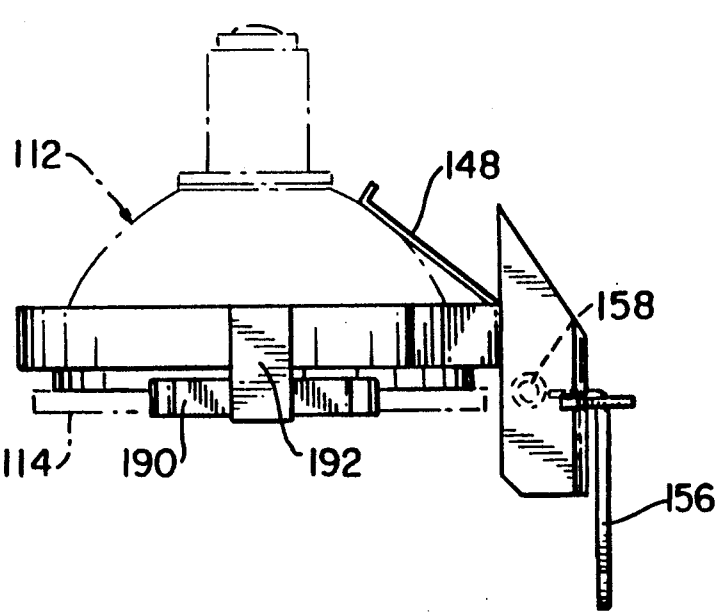
FIG. 14 is a side view of the lamp mount assembly of FIG. 12.
Figure 13:
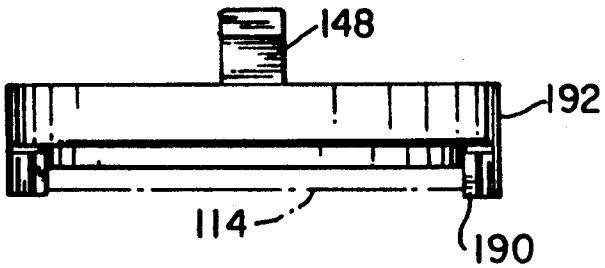
FIG. 13 is a front view of the lamp mount assembly of FIG. 12.
Figure 15:
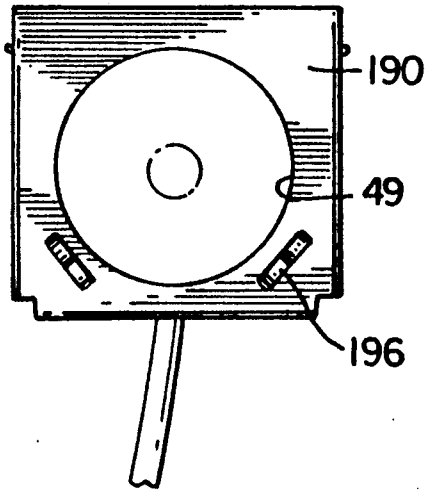
FIG. 15 is a bottom view of a lamp support plate in accordance with yet another embodiment of the invention.

FIGS. 12 through 14 show a lamp support and the lens mount in accordance with another embodiment of the invention. Like the preferred embodiment, the lamp support plate 146 is circular and "cupped" so that a circular rimmed lamp 112 may be positioned in the "cup" and held there by a resilient arm 148. The rear end of the lamp 112 may be connected to a standard bayonet-type electrical connector (not shown).

The lens support arms 190 in this embodiment are attached to the lamp support plate 146 by leg portions 192 and are positioned so that a mounted lens lies adjacent to and between two opposing arms 190. The arms are resiliently biased towards each other so that the lens is securely held until pulled from the resilient grasp of the arms 190.

Figure 18:
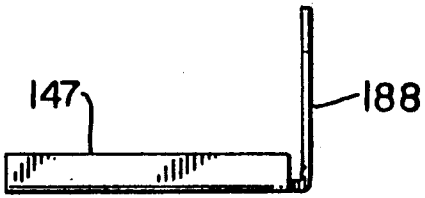
FIG. 18 is a side view of the lamp support plate of FIG. 17.

The lens support arms 190 may also be formed without leg portions 192, in a single plate, as shown in FIGS. 15–18. The lens support plate shown here is formed from sheet metal and is shaped similarly to the lamp support 146. The lens support 190 is a generally square plate having a central opening 49 for allowing the light beam to pass (FIG. 18). The plate-like lens support 190 includes two upwardly directed side walls 147. The side walls 147 are located along each side of the lens support 190 and function to align an inserted lens 114 to a mounted position with respect to the central opening. A back edge of the square lens support 190 is also bent upwardly to form a backing wall 188 to which the lamp support 146 may be attached. The backing wall is shown in FIG. 18. The front side of the square lens support 190 is left open to receive an inserted lens (FIG. 17).

When the lens support 190 is attached just below the lamp support 146, as shown in FIG. 16, a space is defined between the two into which a lens 114 may be inserted. Two detents 196 formed into the cavity from the lens support 190 function as lens stops and align an inserted lens 114 to the mounted position. Also, a resilient arm 194 is located parallel and adjacent to the front edge of the lens support 190, as shown in FIG. 17. The resilient arm 194 is upwardly biased within the cavity and positioned so that an inserted lens 114 forces the arm 194 down. After insertion, the lens is held in the mounted position by the resilient nature of the arm.

From the above description it will be seen that the invention provides improvements to prior art lighting fixtures, however, the invention is not limited to the specific examples described. The different elements of the invention, described above, may be modified in order to meet various conditions and requirements encountered without departing from the scope of the invention.

What is claimed is:

1. A recessed light fixture having a lamp for producing a beam of light through an opening, said lamp having a front portion through which light is emitted and a rear portion at which electrical connections are made, said light fixture comprising:

a collar positioned around said opening;

a lamp mount assembly for holding said lamp;

a pivot arm connected to said lamp mount and pivotally connected to said collar between a zero degree focus position wherein said beam emitted from said front portion of said lamp is directed through and substantially perpendicular to said opening, and a maximum degree focus position wherein said beam emitted from said front portion of said lamp is directed through said opening at a maximum angle;

means for independently tilting said lamp mount with respect to said pivot arm, between a first tilt position wherein said beam of said lamp is directed through said opening and a second tilt position wherein said rear portion of said lamp becomes accessible through said opening; and means for frictionally and selectively immobilizing said lamp mount in any tilt position between, and including, said first and second tilt positions.

2. The lighting fixture according to claim 1 wherein said frictionally and selectively immobilizing means further comprises a locking tab connected to said lamp mount and abutting a surface portion of said pivot arm, said locking tab including a detent which frictionally engages said surface portion of said pivot arm so that said lamp mount retains any preset tilt positions, yet may be easily moved with a one-handed operation to any other tilt position.

3. The lighting fixture according to claim 2 wherein said locking tab further comprises a stop ear which is positioned to engage a portion of said pivot arm and prevent any further tilting of said lamp mount past said first position.

4. The light fixture of claim 1, wherein said collar is rotatable.

5. The light fixture of claim 4 further comprising means for locking said collar thereby preventing rotation of said collar.

6. The light fixture of claim 1 further comprising a lens mounted adjacent to the front portion of the lamp in the path of the emitted beam of light.

7. The light fixture of claim 6 further comprising a lens mount for selectively holding said lens in front of said lamp.

8. The light fixture of claim 7 wherein said lens is removable from said lens mount when said lamp mount is in said second position.

9. The light fixture according to claim 1 further comprising means for locking said pivot arm at a selected angle of tilt.

10. The light fixture of claim 9 wherein said pivot arm locking means includes a threaded opening formed in said pivot arm to receive a screw, said screw is selectively turned to frictionally engage against a portion of said collar thereby locking said pivot arm with respect to said collar at said selected angle of tilt.

* * * * *